US006126509A

United States Patent [19]

Berman

[11] Patent Number: 6,126,509

[45] Date of Patent: Oct. 3, 2000

[54] TOY FIGURE WITH SOUND-GENERATING MECHANISM

[75] Inventor: Stephen Gregory Berman, Malibu, Calif.

[73] Assignee: Jakks Pacific, Inc., Malibu, Calif.

[21] Appl. No.: 09/143,491

[22] Filed: Aug. 28, 1998

Related U.S. Application Data

[63] Continuation-in-part of application No. 08/740,709, Nov. 1, 1996, Pat. No. 5,800,243.

[51] Int. Cl.[7] ..... A63H 5/00

[52] U.S. Cl. ..... 446/418; 446/417; 446/378; 446/375; 446/370

[58] Field of Search ..... 446/369–371, 446/373, 375, 376, 378, 297, 379, 380, 382, 397, 420, 418, 417

[56] References Cited

U.S. PATENT DOCUMENTS

| | | | |
|---|---|---|---|
| 718,662 | 1/1903 | Shaffer | 446/378 |
| 2,940,755 | 6/1960 | Pouder . | |
| 3,277,601 | 10/1966 | Ryan | 446/378 |
| 3,994,092 | 11/1976 | Sapkus et al. | 446/378 |
| 4,268,991 | 5/1981 | Cotey et al. . | |
| 4,470,784 | 9/1984 | Piotrovsky | 425/116 |
| 4,623,317 | 11/1986 | Nagano | 446/289 |
| 4,662,857 | 5/1987 | Quinn et al. | 446/371 |
| 4,673,373 | 6/1987 | Herring et al. | 446/378 |
| 4,750,895 | 6/1988 | Shinohara et al. | 446/230 |
| 4,952,189 | 8/1990 | Barlow | 446/241 |
| 5,007,602 | 4/1991 | Carlsson | 242/246 |
| 5,853,315 | 12/1998 | Satoh | 446/301 |

FOREIGN PATENT DOCUMENTS

| | | |
|---|---|---|
| 1 373 205 | 11/1974 | United Kingdom . |
| 2151 495 | 7/1985 | United Kingdom . |
| 2 091 570 | 8/1989 | United Kingdom . |

*Primary Examiner*—Kien T. Nguyen
*Attorney, Agent, or Firm*—Lyon & Lyon LLP

[57] ABSTRACT

A toy figure having an arm or leg incorporates an internal clicking sound-generating mechanism. For toy figures molded from deformable plastic material, the sound-generating mechanism is within an arm or leg of the toy, and includes first and second members relatively movably engageable with each other inside a closed chamber. A clicking sound is produced thereby, typically when the arm or leg is bent. The arm or leg is formed by an insert molding operation with the plastic material molded to shape completely around the sound-generating mechanism. For other toy figures, such as stuffed animals, the filling or stuffing surrounds the sound-generating mechanism, and the portions of the sound-generating mechanism that engage each other are arranged inside a closed chamber, or at least within an enclosure shaped to substantially exclude the filling or stuffing.

11 Claims, 9 Drawing Sheets

TOY FIGURE WITH SOUND-GENERATING MECHANISM

RELATED APPLICATIONS

This application is a continuation-in-part of U.S. application Ser. No. 08/740,709, filed Nov. 1, 1996, which is now issued as U.S. Pat. No. 5,800,243 to which priority is expressly claimed, and which is hereby incorporated by reference.

FIELD OF THE INVENTION

The present invention relates to a toy figure which incorporates a clicking sound-generating mechanism.

BACKGROUND OF THE INVENTION

Clicking sound-generating mechanisms for toys are generally known. For example, as disclosed in UK Patent Application No. 8431602 published under Publication No. 2151495, one form of a clicking sound-generating mechanism is provided by a resilient finger-like member and a cog wheel which is, upon rotation, momentarily engageable with the finger-like member to produce a clicking sound. Certain other clicking sound-generating mechanisms are disclosed in UK Patent No. 1373205 and UK Patent Application No. 8138187 published under Publication No. 2091570.

SUMMARY OF THE INVENTION

In accordance with one aspect of the present invention, there is provided a toy figure having a body part which is molded of deformable plastic material, said body part having incorporated therein a sound generator or sound-generating mechanism which comprises first and second members relatively movably engageable with each other for producing a clicking or tapping sound upon relative movement thereof, at least the respective portions of said members which are engageable with each other for producing said sound being arranged inside a closed chamber which is substantially impermeable or impervious to the plastic material during molding.

In one embodiment of the invention, the body part is formed by an insert molding operation with the plastic material molded to shape completely around at least the closed chamber.

Conveniently, the members may form the skeleton of the body part and the relative movement of the members may deform and determine the shape or configuration of the body part. In practice, the body part would be bent.

In accordance with another aspect of the present invention, there is provided a toy figure having a part which is molded from deformable plastic material, said part incorporating an internal clicking sound-generating mechanism which has a closed chamber and includes first and second members relatively movably engageable with each other inside said chamber for producing a clicking sound upon relative movement when said part of the toy figure is bent, said part being formed by an insert molding operation with the plastic material molded to shape completely around said sound generator.

Preferably, the chamber is provided by the first member which has a portion inside the chamber for engaging a portion of the second member.

More preferably, the chamber has an opening at which the portion of the second member is positioned closing said opening of the chamber as a sliding fit.

In a preferred embodiment, the members have respective portions and the chamber has an opening to which the portion of the second member is pivotably connected for movably engaging the portion of the first member inside the chamber to produce a clicking sound.

Further more preferably, the portions of the first and second members have a pointed end and a series of teeth, respectively.

Conveniently, the chamber may be formed by two separate parts which are sealed together.

It is preferred that the members are elongate and have adjacent ends connected together for relative pivotal movement.

Preferably, the toy figure has a shape resembling a human being. More preferably, the part is in the form of a limb.

In practice, the toy figure would have a dimension between 5 and 6 inches. In most cases, the toy figure would be less than 12 inches.

The sound-generating mechanism may also be incorporated into toys other than those made of deformable plastic. For example, the mechanism may be used with stuffed animals, including dolls, monsters, etc. The body part in these toys may be formed by a deformable outer shell with filling or stuffing material surrounding or around the sound-generating mechanism. The outer shell may be made of any suitable flexible material such as cloth or leather, and the filling or stuffing may be a fibrous material such as polyester, cotton, or wool, or may be foam beads, beans, or other suitable material. With these types of "stuffed" toys, it is sufficient that the portions of the sound-generating mechanism that engage each other are arranged within an enclosure shaped to exclude the filling or stuffing.

With stuffed toys, the sound-generating mechanism is preferably embodied in a universal ball and socket joint configuration, wherein the ball is secured in a first housing, and the socket is defined by the cooperating end of a second housing which has a hammering pin therein. The ball has a plurality of dimples or indentations, and when the joint is operated the hammering pin engages and disengages various dimples to create the clicking or tapping sound.

BRIEF DESCRIPTION OF THE DRAWINGS

The invention will now be more particularly described, by way of example only, with reference to the accompanying drawings, in which.

DETAILED DESCRIPTION OF PREFERRED EMBODIMENT

Figure 1A:
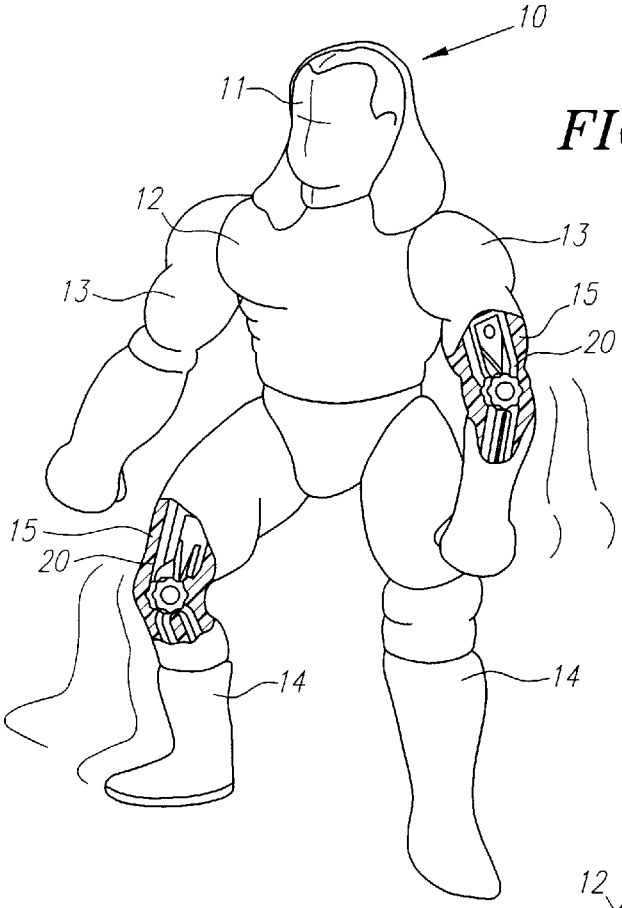
FIG. 1A is a front perspective view of a first embodiment of a toy figure in accordance with the present invention, having an arm and a leg partially broken to show respective internal tooth-and-gear sound-generating mechanisms and deformable plastic material.
Figure 1B:
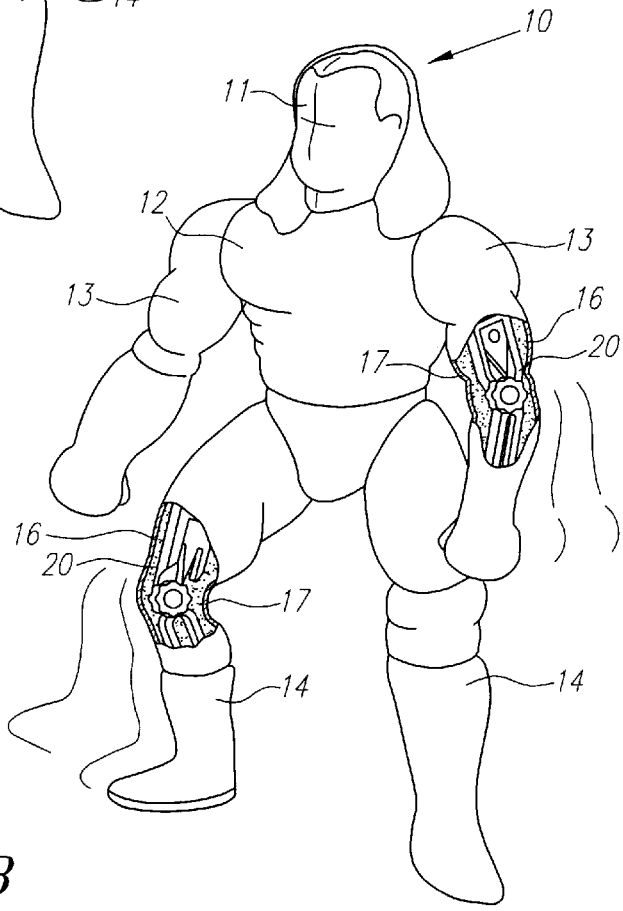
FIG. 1B is same as FIG. 1A except it shows flexible outer shell and fibrous filling or stuffing material in place of deformable plastic material.
Figure 2A:
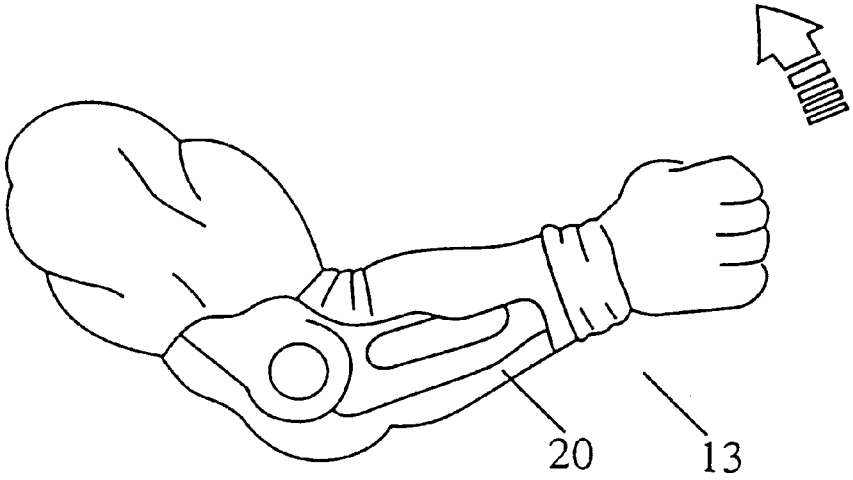
FIG. 2A is a side view of the arm of FIG. 1.
Figure 2B:
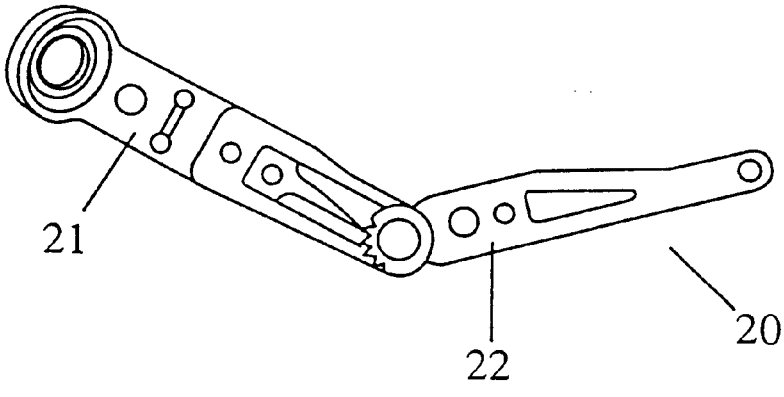
FIG. 2B shows the sound-generating mechanism for the arm.
Figure 3A:
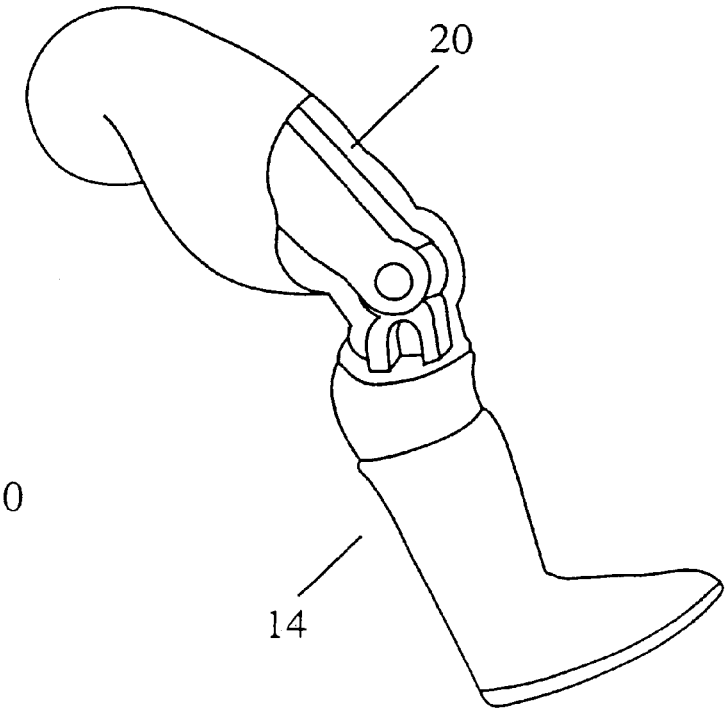
FIG. 3A is a side view of the leg of FIG. 1.
Figure 3B:
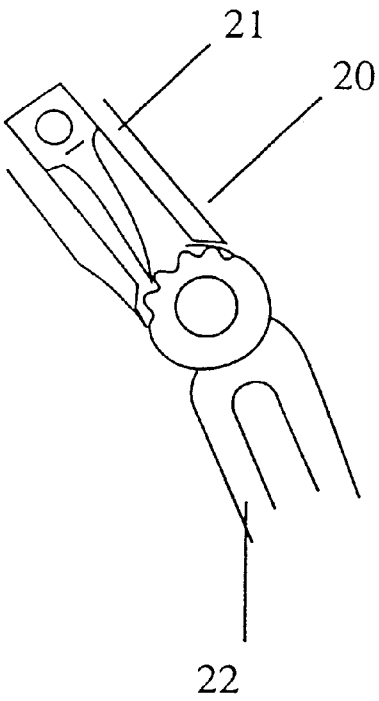
FIG. 3B shows the sound-generating mechanism of the leg.
Figure 4A:
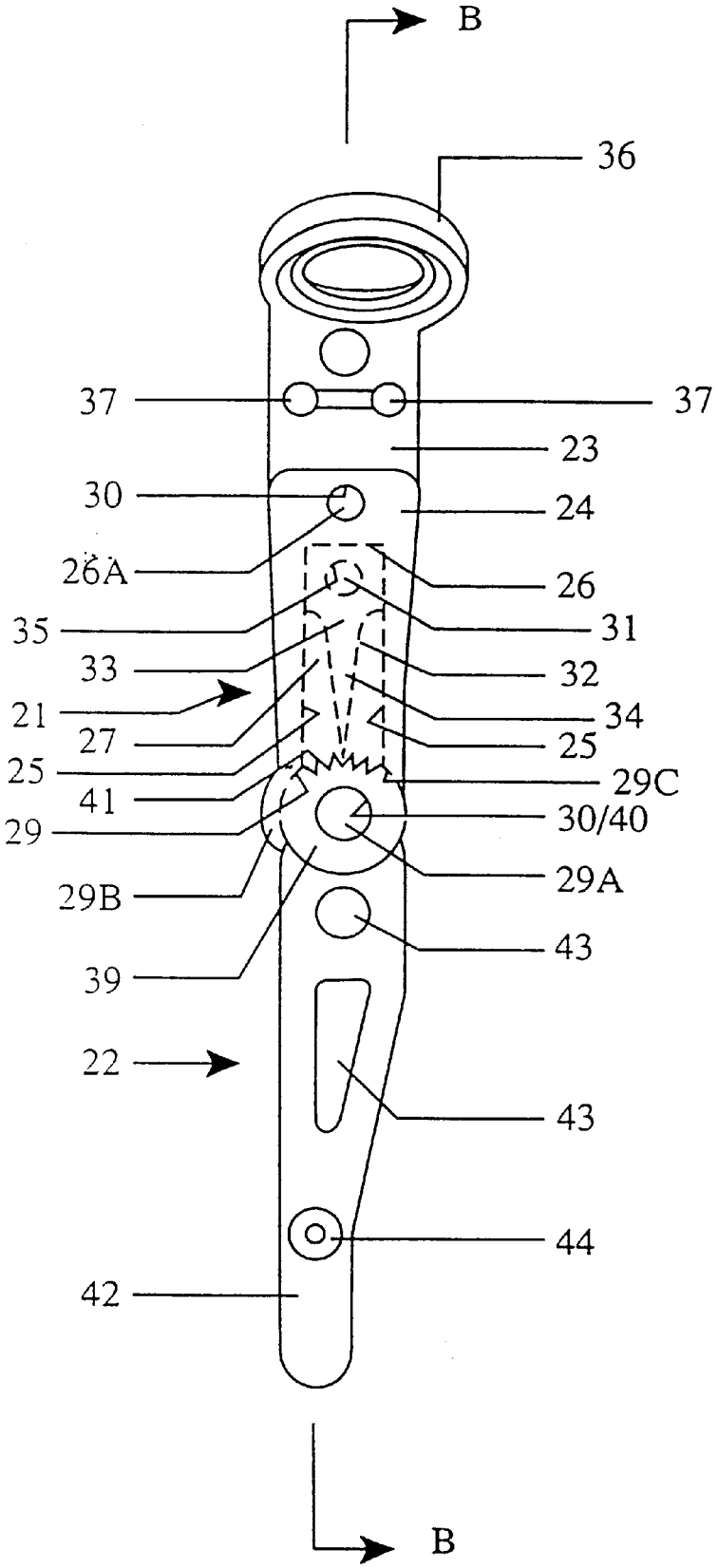
FIG. 4A is a side view of the sound-generating mechanism of FIG. 2B or of FIG. 3B.
Figure 4B:
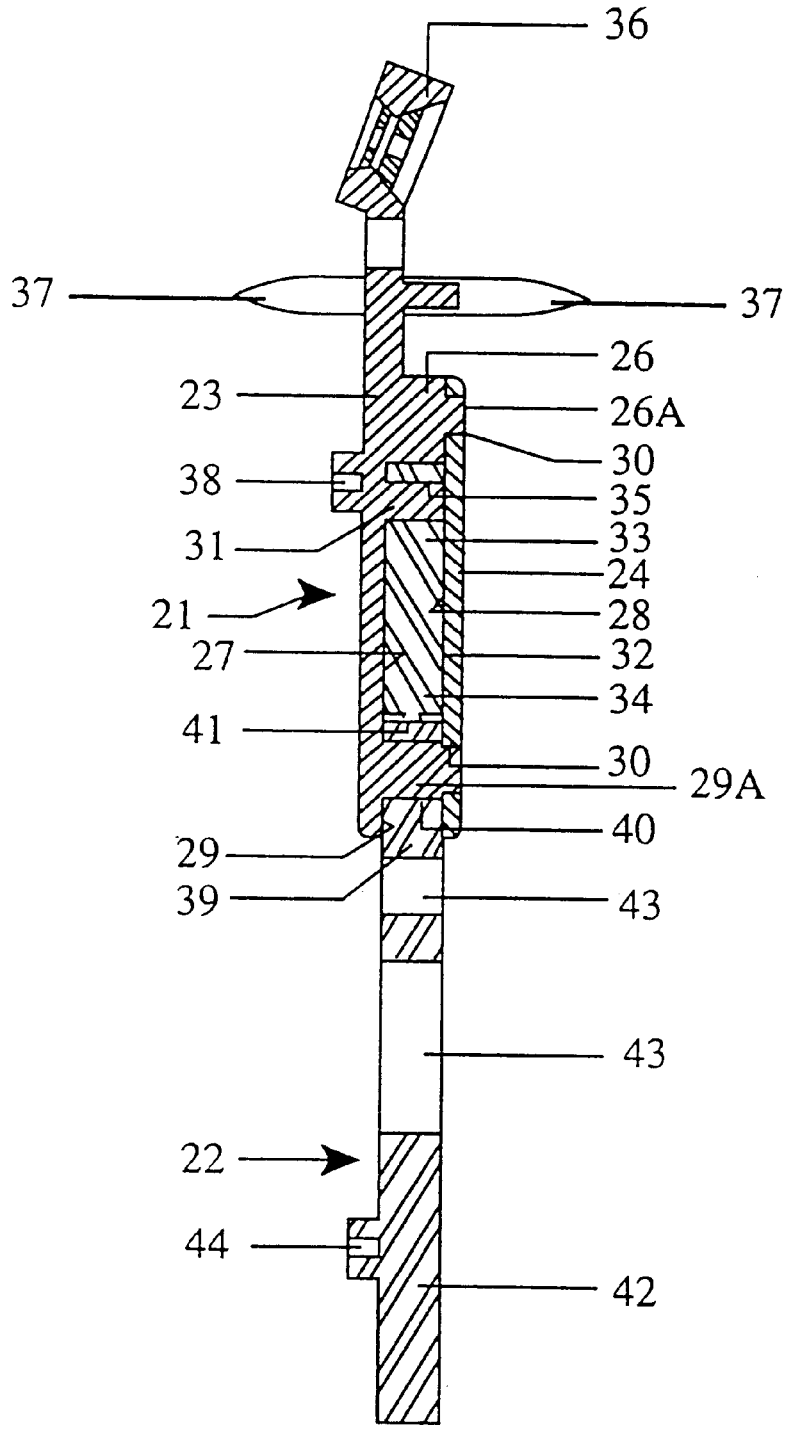
FIG. 4B is a cross-sectional view of FIG. 4A taken along line B—B of FIG. 4A.

Referring to the drawings, there is shown a toy figure, for example in the shape of a human wrestler 10 between 5 and 6 inches in dimension, embodying the invention, which wrestler 10 has a head 11 and a body 12, and two arms 13 and two legs 14. Each arm 13 or leg 14 incorporates an internal sound-generating mechanism 20 which is adapted to produce a clicking sound when the arm 13 or leg 14 is bent at the elbow or knee position. The arms 13 and legs 14 may be molded from PVC plastic material 15 to be slightly flexible or deformable in a resilient manner, or they may be formed of any suitable flexible material 16 such as cloth, with stuffing material 17 contained therein to provide a desired shape. In a first embodiment, the sound-generating mechanism 20 is formed by first and second bars 21 and 22 which are hinged end-to-end together for limited pivotal movement relative to each other to produce the clicking sound.

The first bar 21 is formed by elongate base 23 and lid 24. The base 23 has an integral series of two side walls 25 and an end wall 26 together defining a chamber 27. The chamber 27 is flat and oblong and has an open principal side 28 and an open end 29 opposite to the end wall 26. The end wall 26 and the open end 29 are provided with respective upstanding central posts 26A and 29A. The lid 24, which has opposite end holes 30, closes the open side 28 of the chamber 27 and is located in position by means of its end holes 30 engaging the respective posts 26A and 29A. Ultrasonic welding, heat sealing or glue may be used to secure the lid 24 against the walls 25 and 26, whereby the chamber 27 is fully closed or sealed except at the open end 29 on opposite sides of the post 29A.

Inside the chamber 27, an integral central post 31 is formed on the base 23 close to the end wall 26 and a resilient thin wedge-like blade 32 is held captive. The blade 32 has a broad rear end 33 and a pointed front end 34, said rear end 33 bearing a central hole 35. The rear end 33 has a shape almost the same as that of the end of the chamber 27 closed by the end wall 26 and is fitted in position with the hole 35 engaging the post 31. The front end 34 points, at a small distance off, at the post 29A at the open end 29 of the chamber 27. The base 23 includes, at an end opposite to the chamber open end 29, an inclined integral ring 36, and further includes integral spikes 37 on opposite sides between the chamber 27 and the ring 36 and an integral collar 38 under the chamber 27.

The second bar 22 has a rounded first end 39 which is provided with a central hole 40 to form half a ring. The round end 39 is serrated, on its outermost side, to form a series of triangular teeth 41. Opposite end 42 of the second bar 22 is thinner than the round end 39. The body of the second bar 22 is formed with two openings 43 and an integral collar 44.

To assemble the two bars 21 and 22 together, while they are extending co-parallel, the round end 39 of the second bar 22 is disposed around the post 29A of the first bar 21. The open end 29 of the chamber 27 is thus closed by the round end 39. The lid 24 is then positioned to close and seal the open side 28 of the chamber 27, as described above. In this assembled condition, the blade end 34 of the first bar 21 and the end teeth 41 of the second bar 22 come into inter-engagement inside the chamber 27. Also, the second bar 22 is pivotable, to a limited extent, typical between 180° and 45° about the post 29A relative to the first bar 21.

The open end 29 of the chamber 27 has partially circular opposite sides 29B and 29C to form an angular sliding fit with the respective partially circular sides of the round end 39 on opposite sides of the teeth 41. Such a sliding fit ensures that the chamber 27 is also closed at its open end 29, whereby the chamber 27 is fully closed. One side 29B of the open end 29 is extended to restrict the pivotal movement of the second bar 22 only to the opposite side.

Upon back and forth pivotal movement of the second bar 22 relative to the first bar 21, the teeth 41 of the round end 39 of the second bar 22 will in turn momentarily engage with and disengage from the pointed end 34 of the blade 32 of the first bar 21, thereby producing a clicking sound. Conversely, the first bar 21 may be pivoted back and forth relative to the second bar 22, with the blade end 34 of the first bar 21 clicking through the end teeth 41 of the second bar 22 to produce the same sound.

Each arm 13 or leg 14 in this first embodiment is formed by an insert molding operation, in which the assembled sound-generating mechanism 20 is initially placed inside an appropriate mold and molten PVC plastic material is then injected into the mold to surround and enclose the sound-generating mechanism 20 completely. As the chamber 27 is fully closed or sealed and made impermeable or impervious to the plastic material, the molding material cannot leak into the chamber 27 to clog or otherwise interfere with the workings of the blade 32 and the second bar end 39 including the teeth 41. The sound-generating mechanism 20 is arranged to extend across the elbow or knee, with the first bar 21 along the upper arm or thigh and the second bar 22 along the forearm or lower leg, such that when the limb 13 or 14 is bent about the elbow or knee, the sound-generating mechanism 20 will produce a clicking sound.

The ring 36 of the first bar 21 is exposed at the root end of the arm 13 or leg 14 and provides a rigid opening for hinging the limb 13 or 14 to the body 12 of the wrestler 10. The spikes 37, collars 38 and 44 and openings 43 on the bars 21 and 22 serve as additional formations for anchoring with the set or cured plastic material, thereby avoiding displacement of the sound-generating mechanism 20.

The insert molding operation is commonly used to manufacture toy figures having a dimension less than 12 inches. The molded plastic material used is deformable and has the suitable thickness and flexibility or hardness to allow the arm 13 or leg 14 to be bent into different positions and be able to hold those positions.

In an alternative embodiment, the sound generating mechanism 20 is used with a stuffed toy. In this embodiment, the body part may be formed by a deformable outer shell with filling or stuffing material (not shown) surrounding or around the sound-generating mechanism 20. The outer shell may be made of any suitable flexible material such as cloth or leather, and the filling or stuffing may be polyester, cotton, wool, foam, pellets, or other material suitable for defining a shape of the outer shell. With these types of "stuffed" toys, it is sufficient that the portions of the sound-generating mechanism 20 that engage each other are arranged within an enclosure or chamber 50 shaped to exclude the filling or stuffing. The enclosure 50 does not have to be completely closed.

With stuffed toys, the sound-generating mechanism 20 described in conjunction with the plastic body part may be used. Alternatively, the sound generating mechanism 20 may be embodied in a universal ball and socket joint configuration as seen in FIGS. 5–8. This type of joint provides for a wider range of movement, including different angles, as indicated by arrows 51 in FIGS. 6 and 7.

The ball portion 52 is connected to a stem 54 that is secured in a first housing 56, and the socket 57 is defined by the cooperating end of a second housing 58 which has a hammering pin 60 therein. The ball 52 has a plurality of dimples or indentations 62 thereon, similar to a golf ball, and when the joint is operated the hammering pin 60 engages and disengages various dimples 62 to create the clicking or tapping sound. The size, number, and orientation of the dimples 62 may vary, without departing from the scope of this embodiment of the present invention.

The hammering pin 60 is forced against the indented surface of the ball 52 by a spring element 64, held in place by a washer 66. The tip of the hammering pin 60 may be tapered, and is preferably configured to rest comfortably within an indentation 62 when the joint is not moving. The second housing 58 may comprise apertures for sound dissipation, but the size and/or shape of the apertures must be such that the filling material is excluded from the enclosure 50 where the ball 52 and hammering pin 60 contact each other. It is also preferable that the filling material be excluded from the inside of the second housing 58, at least in the areas where movement of the hammering pin 60 occurs. This would help lessen the likelihood that any filling material might obstruct or otherwise interfere with operation of the hammering pin 60.

When the ball and socket joint is operated, thereby moving the ball 52 and the socket 57 relative to each other, a clicking or tapping sound is generated by the tip of the hammering pin 60 moving from one indentation 62 to another. The relative movement may also cause the hammering pin 60 to vibrate and produce a louder and longer lasting sound.

It is preferred that more than half of the ball portion 52 is received in the socket 57, and that the socket opening is smaller than the circumference of the ball portion 52, so that the ball portion 52 stays operatively secured within the socket 57 without the use of any additional attachments.

Figure 9A:
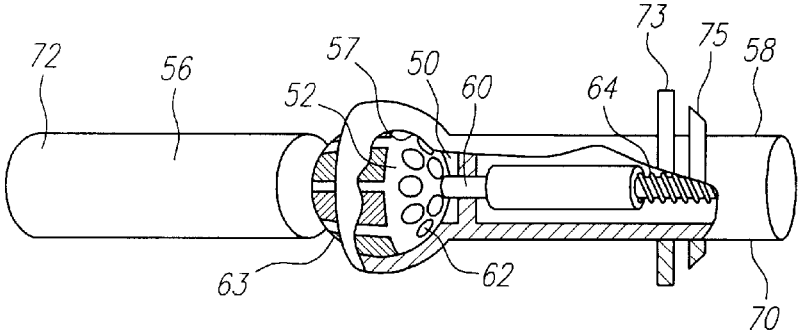
FIGS. 9A–9B are partial cutout views of a straight housing showing an alternative embodiment of the ball, and also showing ridges at the lower end of the second housing.
Figure 9B:
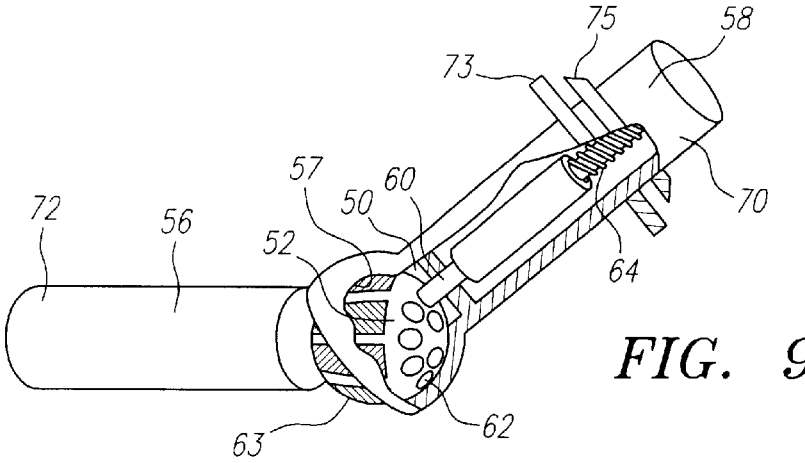

Turning briefly to FIGS. 9A–9B, an alternative embodiment of the ball portion 52 is shown in which the ball portion 52 does not comprise a continuous substantially spherical surface. Rather, only the part of the ball portion 52 that includes dimples 62 has a continuous substantially spherical surface, but the remainder of the ball portion 52 is in the form of a spherical skeleton or structural frame 63. In this embodiment, less material is needed to manufacture the ball portion 52. Such a configuration operates effectively, because as seen in FIG. 9B, the spherical skeleton 63 is not contacted by the hammering pin 60, but serves primarily to allow the second housing 58 to maintain its desired range of movement as part of the ball and socket joint.

Figure 5:
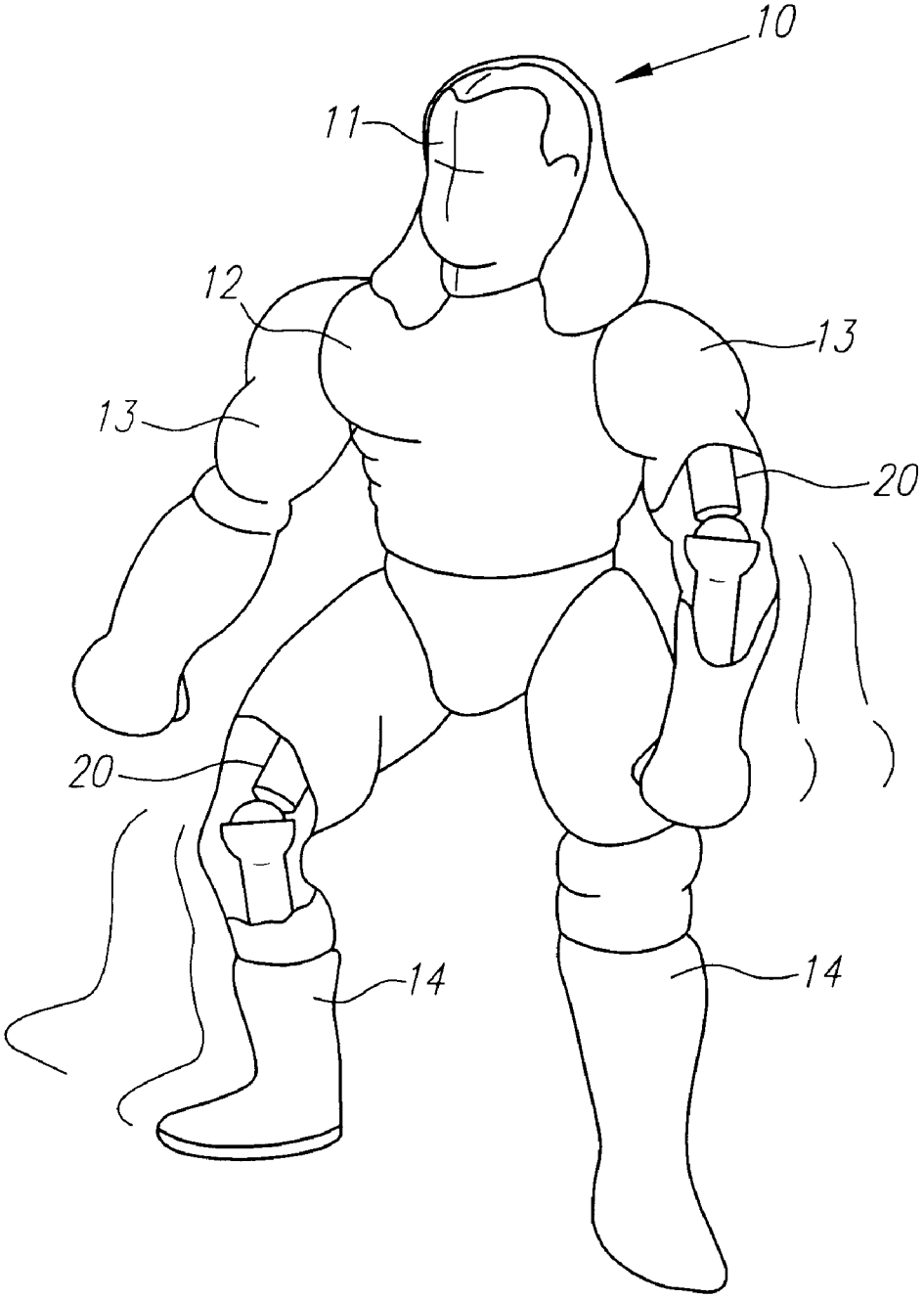
FIG. 5 is a front perspective view of a second embodiment of a toy figure in accordance with the present invention, having an arm and a leg partially broken to show respective internal ball and hammering pin sound-generating mechanisms.
Figure 6A:
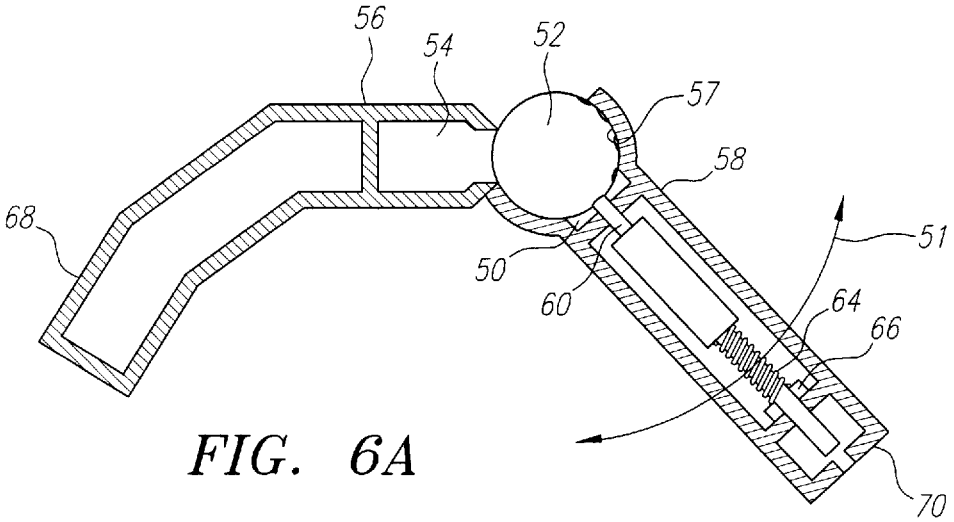
FIGS. 6A–6C are side views showing the ball in an angular housing.
Figure 6B:
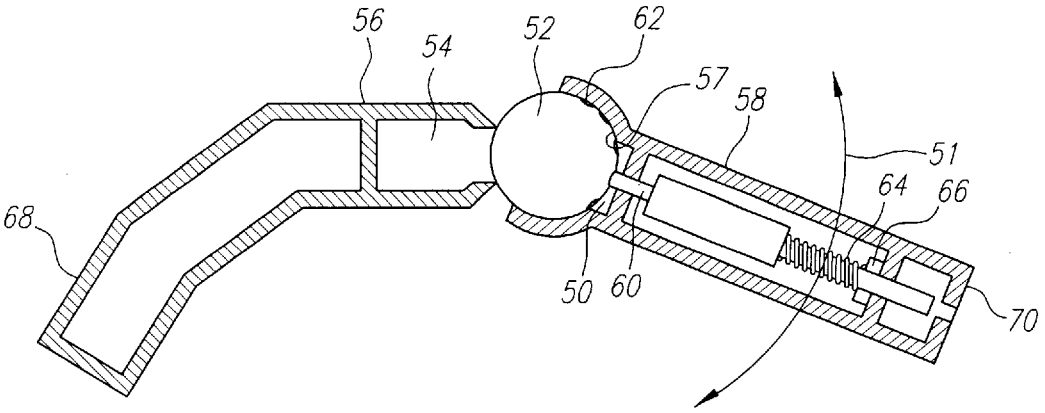
Figure 6C:
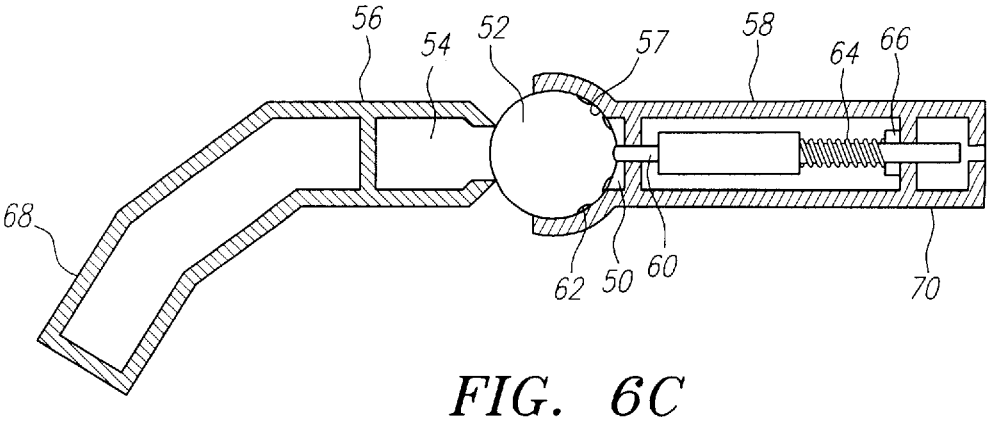
Figure 7A:
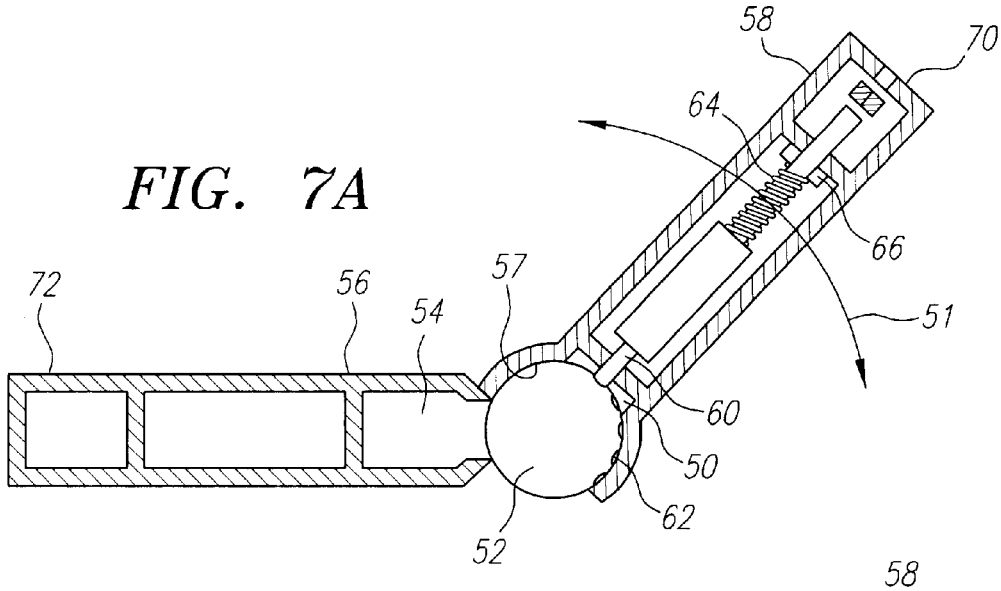
FIGS. 7A–7C are side views showing the ball in a straight housing.
Figure 7B:
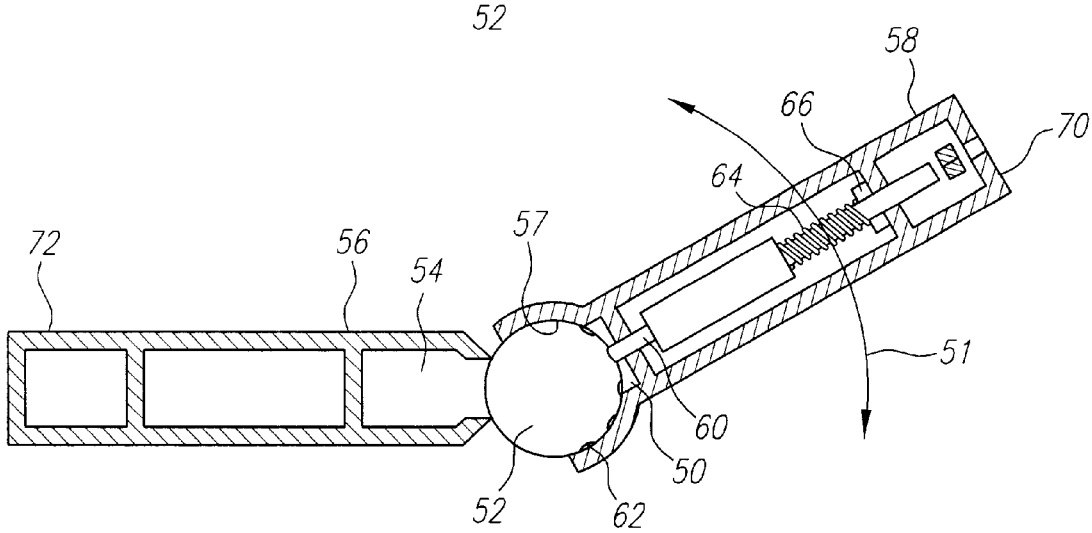
Figure 7C:
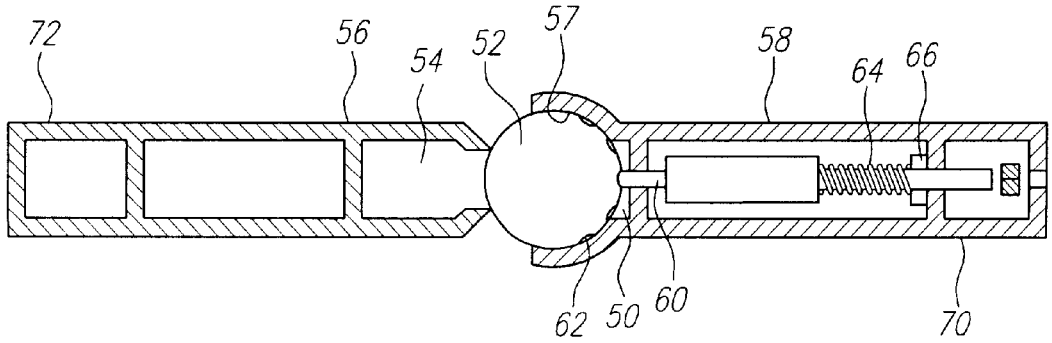
Figure 8A:
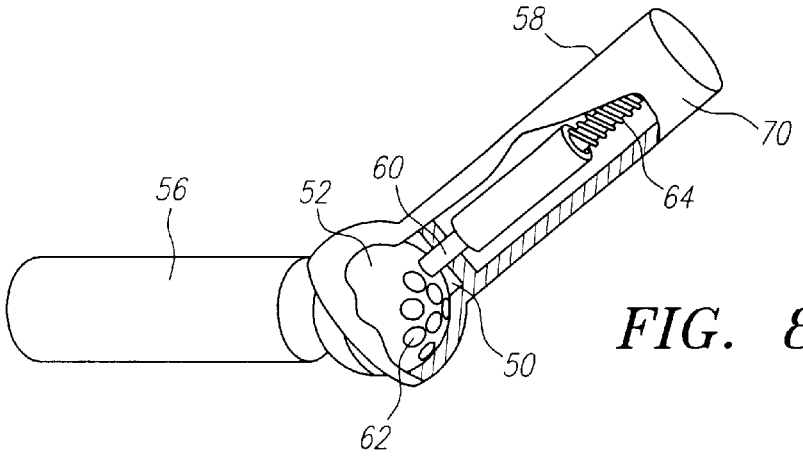
FIGS. 8A–8B are partial cutout views of the ball and hammering pin mechanism in various positions, showing engagement of the hammer with the dimples on the ball.
Figure 8B:
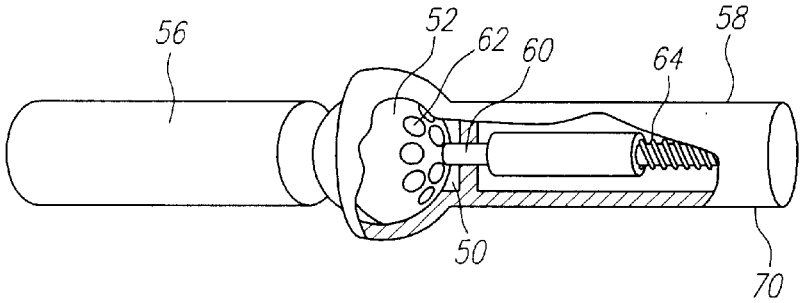

The first housing 56 may be angular as seen in FIG. 6A–6C, or straight as seen in FIGS. 7A–7C, and generally will form the skeleton of the upper portion of a limb (see FIG. 5). As seen in FIG. 5, the angular version is preferred where the body part containing the sound generator 20 is an arm, and the straight version is preferred where the body part is a leg. The upper end 68 of the angular version of the first housing 56 is preferably fixed to the torso of the toy doll at the shoulder position, while the lower end 70 of the second housing 58 is fixed to the hand of the toy doll. Thus, the first housing 56 forms the skeleton of the upper arm (shoulder to elbow), while the second housing 58 forms the skeleton of the lower arm or forearm (elbow to hand). Similarly, for the straight version of the first housing 56, one end may be fixed to the lower part of the torso at the hip position, while the other end is fixed to a foot. Thus, in one orientation, the upper end 72 of the straight version of the first housing 56 is fixed to the lower part of the torso at the hip position, and the first housing forms the skeleton for the upper leg (hip to knee), while the lower end 70 of the second housing is fixed to a foot of the toy figure, and the second housing forms the skeleton of the lower leg (knee to foot). In the opposite orientation, the first housing 56 is fixed to a foot while the second housing 58 is fixed to the torso. Ribs or ridges 73 (see FIGS. 9A–9B) may be provided at the lower end 70 of the second housing 58 to provide a mechanism for attaching a hand (with respect to the angular version of the second housing 58) or foot (with respect to the straight version of the second housing 58) of the toy FIG. 10 thereto. The ribs or ridges 73 may be tapered on one side, as seen at 75.

Preferably, the hands, feet, gloves, boots, etc., as well as the head of the toy figure, are made of deformable plastic and are hollow inside, while the arms, legs, and torso of the toy figure are formed of a flexible outer shell such as cloth, leather, or PVC. However, the hands, feet, gloves, boots, etc., as well as the head, may also be made of a flexible outer shell and filled with stuffing material as the rest of the toy figure. The limbs are stuffed with soft filling material around the sound generating mechanism 20.

The invention has been given by way of example only, and various other modifications of and/or alterations to the described embodiment may be made by persons skilled in the art without departing from the scope of the invention as specified in the appended claims. For example, it is envisaged that the sound-generating mechanism 20 may be provided across the neck or waist of the wrestler 10, for producing a clicking or tapping sound when the neck or waist is bent.

What is claimed is:

1. A toy figure comprising:

a deformable body part with filling material contained therein, wherein said body part is formed by a flexible shell, and the filling material comprises a fibrous material; and a sound generating mechanism within said body part, said sound generating mechanism comprising first and second members;

wherein said filling material substantially surrounds said sound generating mechanism; and wherein said first and second members of said sound generating mechanism have portions, the portion in one member comprising a ball having a plurality of dimples and the portion in the other member comprising a hammering pin, said portions being relatively moveably engageable with each other and configured to produce a clicking or tapping sound upon relative movement thereof, said portions being arranged in an enclosure shaped to substantially exclude said filling material.

2. The toy figure as in claim 1, wherein said enclosure is a closed chamber.

3. The toy figure as in claim 1, wherein the ball portion is secured in a first housing, and the hammering pin portion is within a second housing, said housings forming a skeleton of the body part.

4. The toy figure as in claim 3, wherein the ball portion mates with a socket portion of the second housing to form a ball and socket joint.

5. A toy figure comprising:

a deformable body part comprising an outer shell and filling material contained within said shell, wherein the filling material comprises a fibrous material;

a sound generating mechanism comprising first and second members contained within said body part, said filling material surrounding said sound generating mechanism;

wherein said first and second members have portions, the portion in one member comprising a ball having plurality of dimples and the portion in other member comprising a hammering pin, said portions being relatively movably engaged with each other inside an enclosure to produce a clicking or tapping sound within said enclosure upon relative movement thereof, and said enclosure being configured to substantially exclude said filling material therefrom.

6. The toy figure as in claim 5 wherein relative movement of the portions of the first and second members is achieved by bending the body part.

7. The toy figure as in claim 5 wherein the enclosure is a closed chamber.

8. The toy figure as in claim 5, wherein the ball portion is secured in a first housing, and the hammering pin portion is within a second housing, said housings forming a skeleton of the body part.

9. The toy figure as in claim 8, wherein the ball portion cooperates with a socket portion of the second housing to form a ball and socket joint.

10. The toy figure as in claim 8 wherein the toy figure has the shape of a human being.

11. A toy figure comprising:

a deformable body part comprising a flexible outer shell with filling material contained therein;

a sound generating mechanism comprising first and second members contained within said body part, said sound generating mechanism being substantially surrounded by said filling material;

said first and second members having respective portions that are relatively movably engaged with each other inside an enclosure to produce a clicking or tapping sound upon relative movement thereof, said enclosure being shaped to exclude said filling material; and wherein the first member comprises a ball, the second member comprises a hammering pin, and wherein said ball is contained in a first housing forming an upper part of a limb of the toy figure, and said hammering pin is contained in a second housing forming a lower part of the limb, said housings together forming a skeleton of the limb such that when the limb is bent, the housings bend relative to each other and the ball and hammering pin move relative to each other and form the clicking or tapping sound.

* * * * *

UNITED STATES PATENT AND TRADEMARK OFFICE

CERTIFICATE OF CORRECTION

PATENT NO. : 6,126,509
DATED : October 3, 2000
INVENTOR(S) : Stephen Gregory Berman It is certified that error appears in the above-identified patent and that said Letters Patent is hereby corrected as shown below:

Column 6,
Line 20, please change "toy FIG. 10" to -- toy figure 10 --

Signed and Sealed this

Nineteenth Day of March, 2002

*Attest:*

*Attesting Officer*

JAMES E. ROGAN
*Director of the United States Patent and Trademark Office*